US006223351B1

(12) United States Patent
Marie

(10) Patent No.: US 6,223,351 B1
(45) **Date of Patent: *May 1, 2001**

(54) SEAMLESS SWIMWEAR

(76) Inventor: Jone Marie, 255 N. El Cielo #307, Palm Springs, CA (US) 92262

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/206,998

(22) Filed: Nov. 16, 1998

(51) Int. Cl.[7] ..... A41D 7/00
(52) U.S. Cl. ..... 2/67; 2/69
(58) Field of Search ..... 2/69, 76, 67, 78.1, 2/78.2, 109, 110, 111; D02/731

(56) References Cited

U.S. PATENT DOCUMENTS

| | | | | |
|---|---|---|---|---|
| D. 87,725 | * | 9/1932 | Michelson | 2/67 |
| D. 138,422 | * | 8/1944 | Mitchell | D3/17 |
| D. 239,667 | * | 4/1976 | Bouchard | D2/2 |
| D. 249,096 | | 8/1978 | Fowler . | |
| 1,868,741 | * | 7/1932 | Gassel | 2/67 |
| 1,886,416 | * | 11/1932 | Monroe | 2/67 |
| 1,930,034 | * | 10/1933 | Bergh | 2/67 |
| 1,954,526 | * | 4/1934 | Holahan | 2/67 |
| 1,990,567 | * | 2/1935 | Rothblum | 2/67 |
| 2,038,301 | * | 4/1936 | Levi | 2/67 |
| 2,060,689 | * | 11/1936 | Read | 2/67 |
| 2,104,943 | * | 1/1938 | D'Achon | 2/67 |
| 2,412,502 | * | 12/1946 | Garrison | 2/67 |
| 3,012,249 | * | 12/1961 | Laszlo | 2/243 |
| 3,704,469 | * | 12/1972 | Levy | 2/67 |
| 4,694,511 | * | 9/1987 | Estes et al. | 2/69 |
| 4,698,847 | * | 10/1987 | Yoshihara | 2/69 |
| 5,189,736 | * | 3/1993 | Price | 2/69 |
| 5,561,858 | * | 10/1996 | Poirier | 2/67 |
| 6,016,569 | * | 1/2000 | Everett et al. | 2/67 |
| 6,035,439 | * | 3/2000 | Chin | 2/67 |

FOREIGN PATENT DOCUMENTS

| | | | | |
|---|---|---|---|---|
| 430605 | * | 5/1934 | (GB) | 2/67 |

OTHER PUBLICATIONS

Gershman, Maurice, "Self–adhering Nylon Tapes", Journal of the American Medical Asso. vol. 168,p.930.*

* cited by examiner

*Primary Examiner*—John J. Calvert
*Assistant Examiner*—Alissa L. Hoey

(57) ABSTRACT

A method for designing unique swimwear, more particularly, women's swim suits by creating swimwear exclusive of bottom side seams, making certain attributes available such as a slim appearance; a comfortable fit and quick-change ability. Thus, the present invention is designed to reflect current and trendy fashions, yet hold the unique quality of side seam exclusion which allows for individual comfort, durability and quick-change ability. Further, manufacturing production cost is down due to the fact that the swim suit can be manufactured and sold in sizes S-M-L only.

4 Claims, 6 Drawing Sheets

FIG. 4
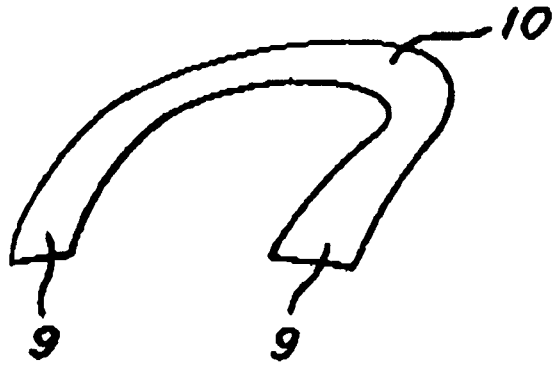
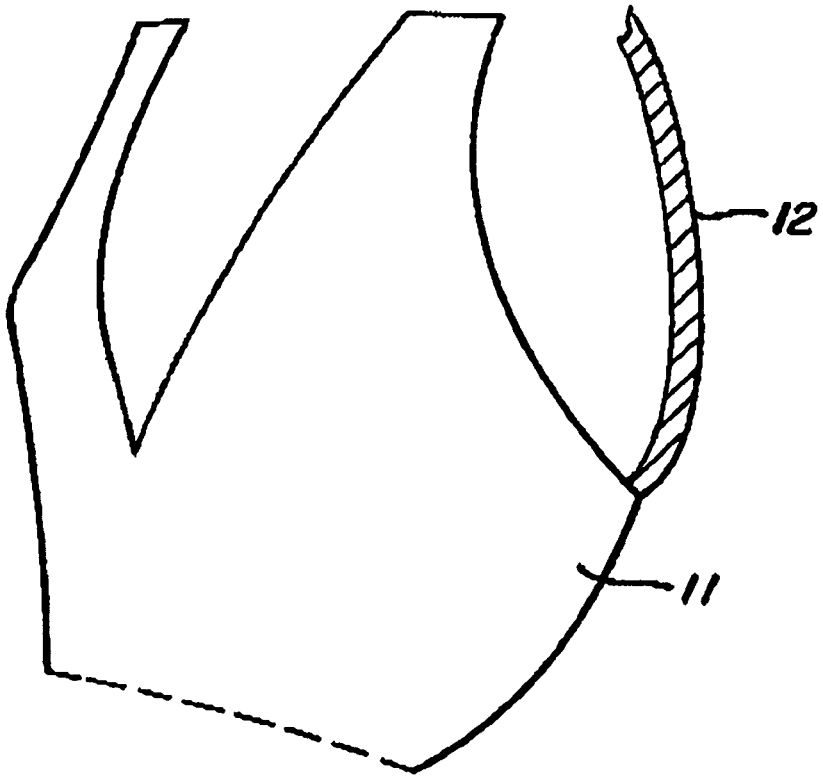
FIG. 5

SEAMLESS SWIMWEAR

CROSS-REFERENCES TO RELATED APPLICATIONS

Not applicable

STATEMENT REGARDING FEDERALLY SPONSORED RESEARCH AND DEVELOPMENT

Not applicable

BACKGROUND OF THE INVENTION

REFERENCE TO A "MICROFICHE APPENDIX"

Not applicable

This invention relates to women's swimwear, affording the elimination of the bottom side seam and more particularly a swimwear that, in addition to the novelty of side seam elimination, further maintains current and trendy designs, is comfortable, slimming, sold in three sizes and is economically feasible.

1. Field of Invention

This invention relates to women's seamless swimwear, specifically to a sometimes triangular shaped fabric, a belting and/or elasticized closure herein known as Melange Segments which are attached to bottom-wrap of swim suit, thus eliminating the need for the side seam.

2. Background Art

Prior patent art known to me as a result of Office Action sent Nov. 29, 1999 and a patentability search includes the following: U.S. Pat. No. D239,667 granted April 1976 to Bouchard; U.S. Pat. No. 2,060,689 granted November 1936 to Read; U.S. Pat. No. 5,189,736 granted March 1993 to Price; U.S. Pat. No. 249,096 granted August 1978 to Fowler.

U.S. Pat. No. D239,667 granted April 1976 to Bouchard. The Bouchard patent is of single-ornamental design which consists of fabric with three separate Wide fabric ties placed at the following areas: (1) at back of neck, (2) at center back; and (3) in front at waist. The present invention consists of multi-Bottom Constructions 2, 8, 18, 36 in a variety of cuts which mimic quasi-trendy and trendy designs defined as: (a) Jowings Melange Segment 29 (b) Niacon Melange Segment 32 and (c) Zshwings Melange Segment 31 and a Top Construction 1, 6, 14, 21 combined with the fundamental Bottom Construction 2, 8, 18, 36. The present invention consists of the method of combination and can be used, as illustrated with numerous and trendy designs. Bouchard clearly is limited in scope as to the single-ornamental design whereas the present invention, as claimed, clearly distinguishes with a variety of cuts to mimic quasi-trendy and trendy designs consisting of but not limited to the Melange Segments thus the present invention can at all times be of a modern ornamental design, holding the uniqueness of the elimination of the bottom front to back side seams of the swim suit. Further, the present invention consists of the method of part combinations which is multi-functional keeping the design of the swim suit fashionable.

U.S. Pat. No. 2,080,689 granted November 1936 to Read. D. Read creates a bathing suit, which is pleasing to the eye and allows for sunbathing with protection of modesty. The Read has connections with overlapping edges and connects at back. The present invention is wrapped from back to front with the connection at front. The present invention creates multi-trendy Top Constructions 1, 6, 14, 21 to join quasi-trendy Bottom Constructions 2, 8, 18, 36 and for ease of entry and removal of the top portion of the swim suit eliminates the bottom side seam. The present invention demonstrates a unique method for the elimination of the bottom side seam to facilitate those times when a quick-change is needed by the wearer. For instance a triathlon. That portion of the swim suit connections are uniquely named as (a) Jowings Melange Segment 25, 29, Niacon Melange Segment 32 and (c) Zshwings Melange Segment 31 and each allows for this connection using same parts although a different Melange Segment(s). These specific connections allow the present invention to be manufactured in three basic sizes. The present invention consists of the method of part combinations which is multi-functional keeping the design of the swim suit fashionable. Thus reducing current manufacture over-production.

U.S. Pat. No. 5,189,736 granted March 1993 to Price. Price creates a "support garment for use during exercise" where panels are attached, designed and constructed for the biomechanics of exercise typically resulting in increased stresses on the lower back and buttocks or gluteal region. The Price exercise garment has full and rigid seams to aid in this objective. The present invention creates multi-trendy Top Constructions 1, 6, 14, 21 to join quasi-trendy Bottom Constructions 2, 8, 18, 36 and for ease of entry and removal of swim suit designed to eliminate the bottom front to back side seam. The present invention's basic construction is comprised of the opposite theory of the Price support garment The present invention demonstrates a unique method for the elimination of the bottom side seam (with or without attachment to a Top Construction) to facilitate those times when a quick-change is needed by the wearer. For instance a triathlon. The Melange Segments allow the swim suit to be manufactured in three basic sizes. Thus reducing current manufacture over-production. The present invention consists of the method of part combinations which is multi-functional keeping the design of the swim suit fashionable.

U.S. Pat. No. 249,096 granted August 1978 to Fowler. Catalina Fowler creates a bathing suit, which is pleasing to the eye and is held together with four string ties. The Fowler has the elongated front folding under and then covering the buttocks and appears to tie at the back hip area. The front has a low cut bodice with ties that tie behind the neck of the wearer. The Fowler is of a one-dimensional ornamental design. The present invention creates multi-trendy Top Constructions 1, 6, 14, 21 to join quasi-trendy Bottom Constructions 2, 8, 18, 36 and for ease of entry and removal of the top portion of the swim suit eliminates the bottom side seam. The present invention demonstrates a unique method for the elimination of the bottom side seam to facilitate those times when a quick-change is needed by the wearer. For instance a triathlon. That portion of the swim suit connections are uniquely named as (a) Jowings Melange Segment 25, 29, Niacon Melange Segment 32 and (c) Zshwings Melange Segment 31 and each allows for this connection using same parts although a different Melange Segment(s). These specific connections allow the present invention to be manufactured in three basic sizes. The present invention consists of the method of part combinations which is multi-functional keeping the design of the swim suit fashionable. Thus reducing current manufacture over-production.

None of the prior art patents listed above, whether taken singly or in any combination with one another, solves the aforementioned problems or anticipates or, for that matter, includes the structural and functional features of the present invention. Indeed, none of these patents even attempt to solve the aforementioned problems and, as such, each is unable to fulfill the objects of the present patent.

1 Top Construction

2 Bottom Construction

Figure 1:
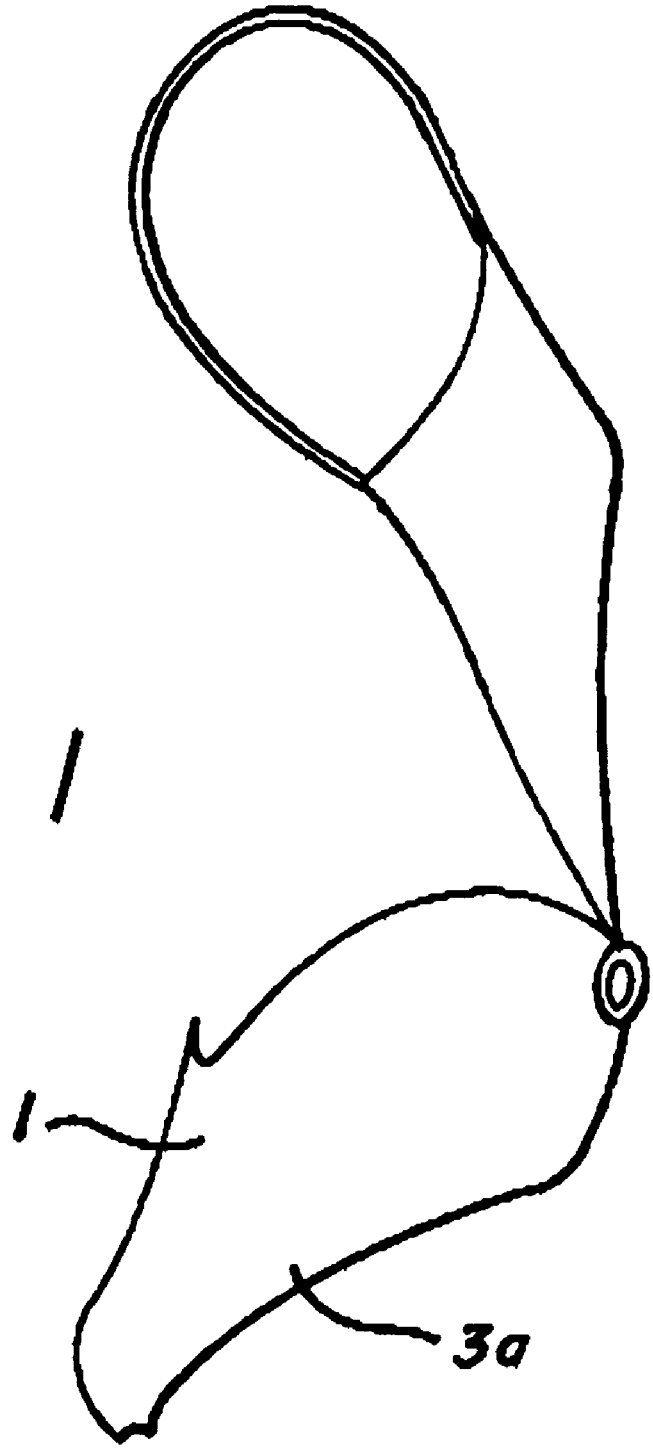
FIG. 1—Perspective Side View
Figure 2:
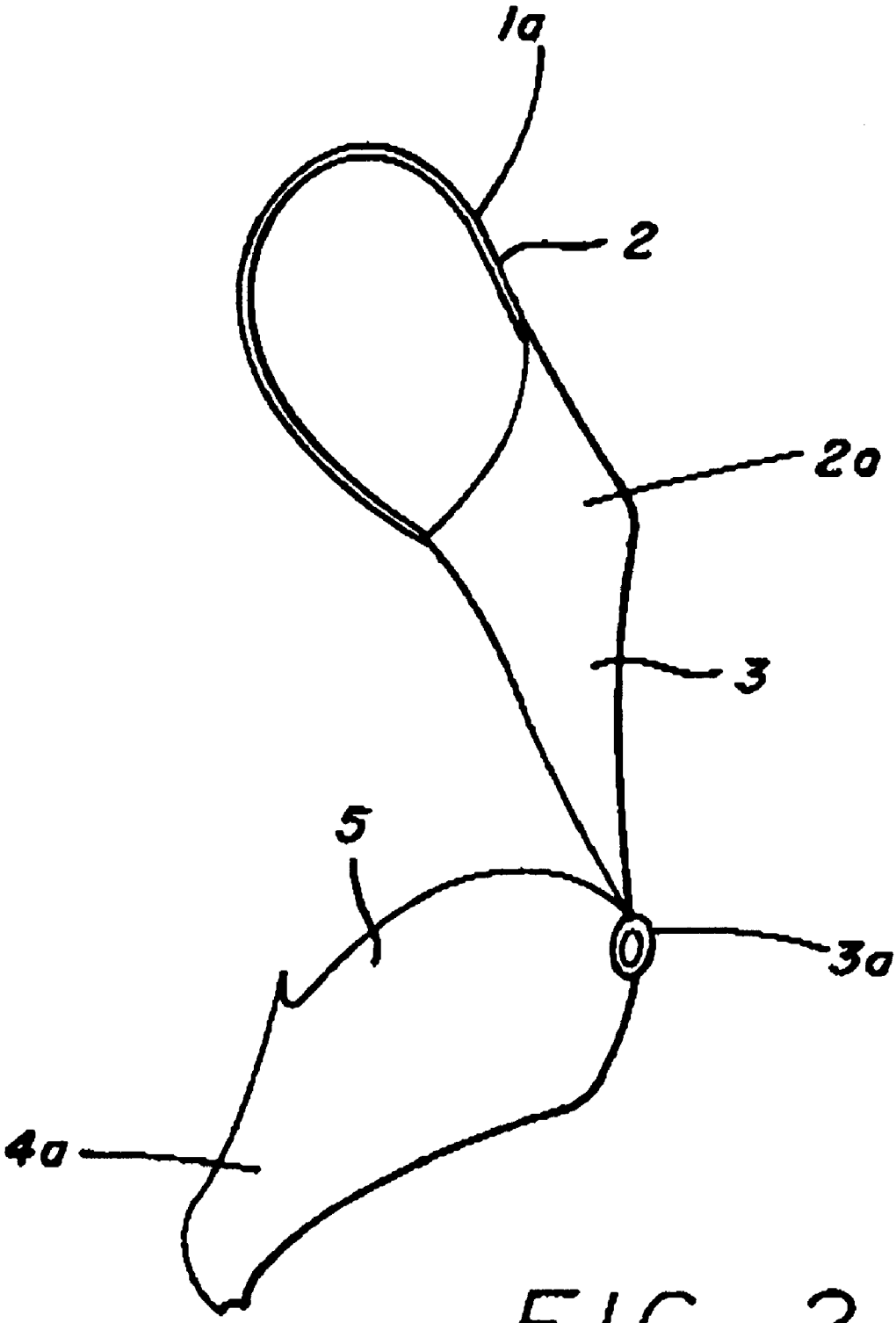
Figure 3:
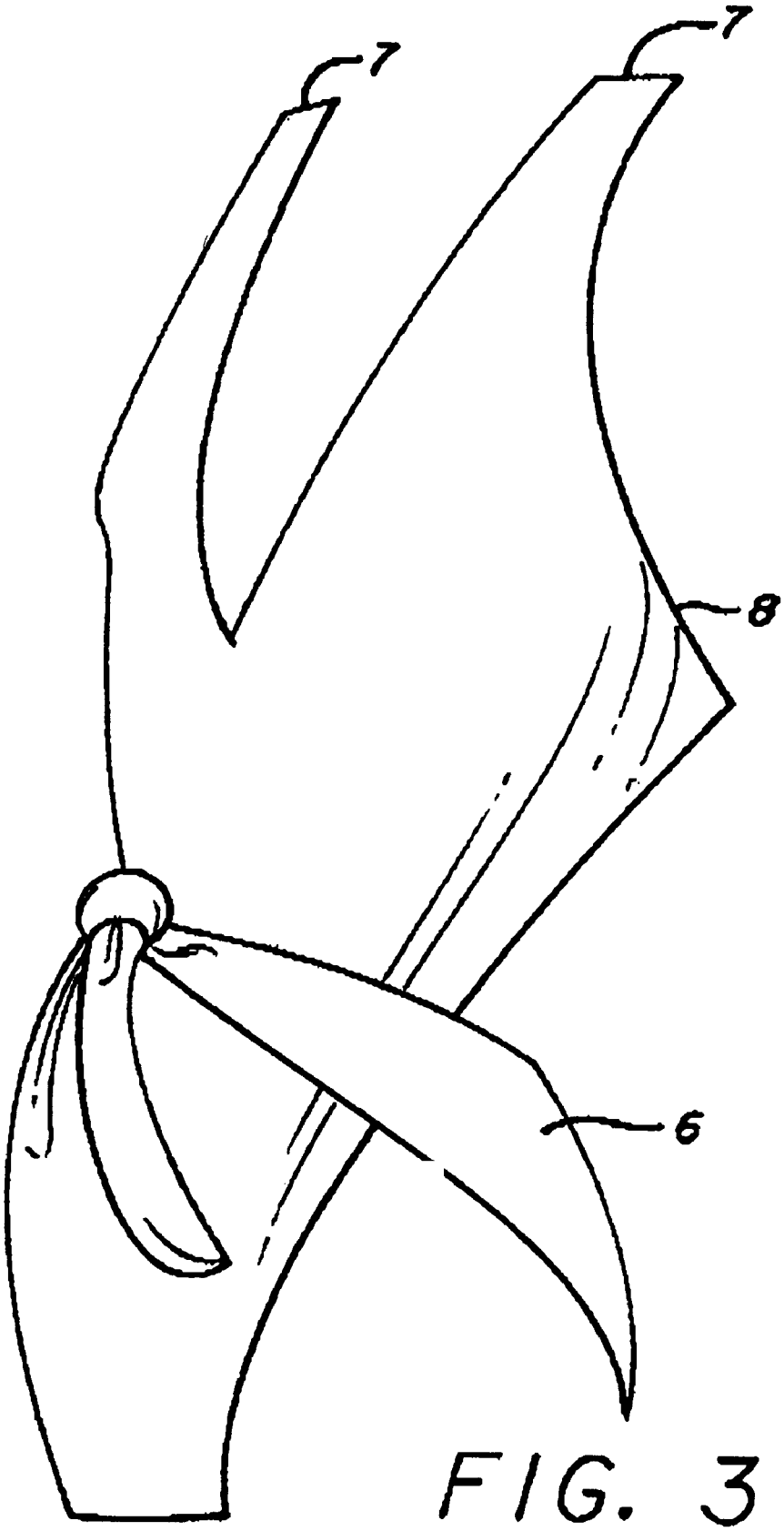

FIG. 2—Side View Detail

3 Straps

4 Connecting Mechanism

5 Bodice Construction

6 Top Construction

7 Connecting Mechanism

8 Bottom Construction

9 Wings

10 Side-wrap

11 Bottom-wrap

12 Under-wrap

FIG. 3—Front View

13 Straps

14 Top Construction

15 Bodice Construction

16 Connecting Mechanism

17 Side-Wrap

18 Bottom Construction

19 Bottom-wrap

FIG. 4 Neckline Assembly

20 Straps

21 Top Construction

FIG. 5—Bodice Assembly

22 Straps

23 Top Construction

24 Bodice Construction

Figure 6:
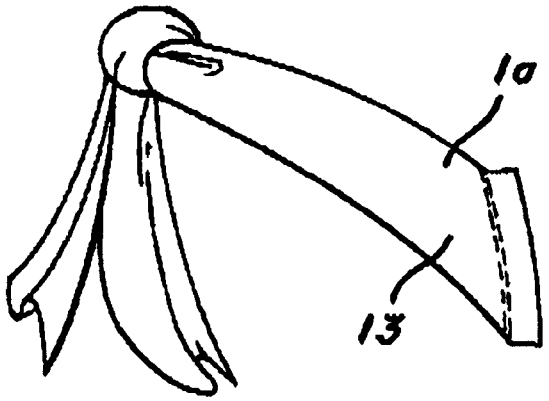
Figure 6:
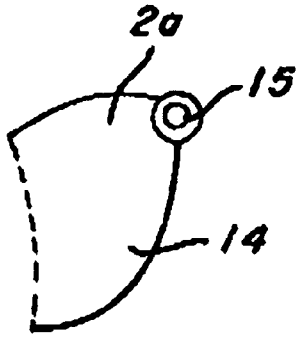

FIG. 6—Melange Segments

25 Jowings Melange Segment

26 Connecting Mechanism

27 Wings

28 Connecting Mechanism

29 Jowings Melange Segment

Figure 7:
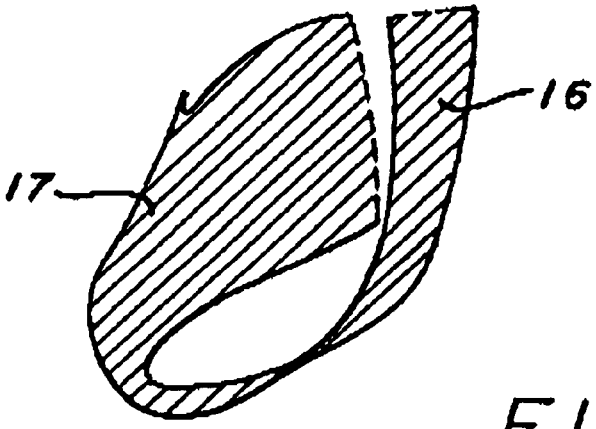

FIG. 7 Bottom Construction

30 Front Edges with Connecting Mechanism

31 Zshwings Melange Segment

32 Niacon Melange Segment

33 Connecting Mechanism

34 Top edge.

35 Front Edges

36 Bottom Construction

37 Bottom-wrap

Figure 8:
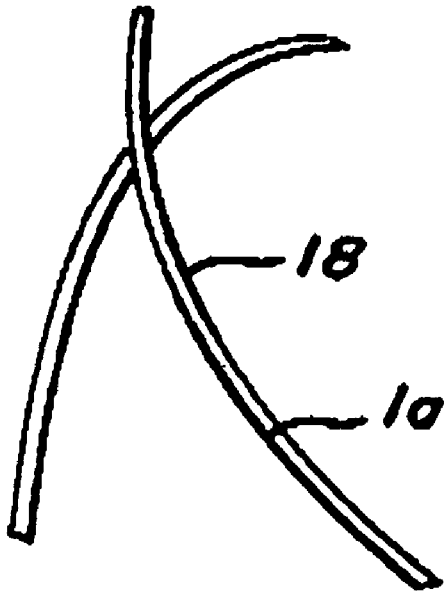
Figure 8:
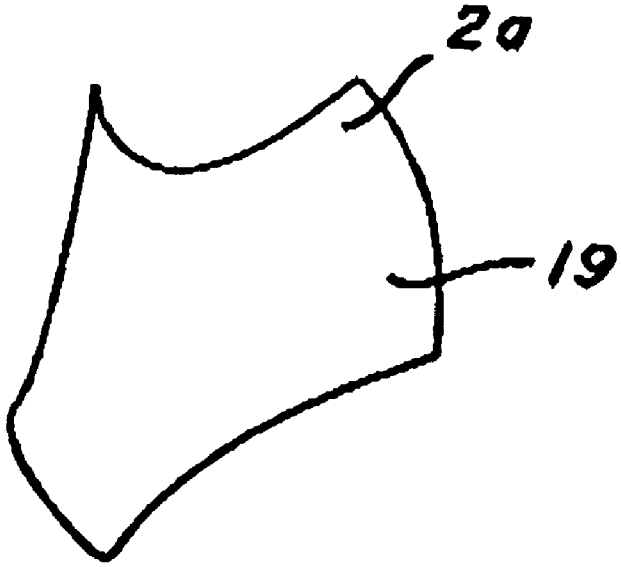

FIG. 8—Back view of Strip Swim wear

38 Straps

39 Bottom Construction

40 Bottom-wrap

DETAILED DESCRIPTION OF THE INVENTION

The present invention relates generally to swim suits, and more particularly to a method for making novel swimwear from current trendy designs by adding one of three part combinations known herein as "Melange Segments" to produce swimwear exclusive of bottom front-to-back side seam. These three melange segment configurations are specifically named to facilitate definition of this invention and are known as: 29 Jowings Melange Segments, 31 Niacon Melange Segments and 31 Zshwings Melange Segments. Further, the present invention can be used in two piece swim suit designs or as a topless swim suit. Thus, it now becomes obvious that this present invention produces new and unexpected results.

Referring now to the drawings, and in particular to FIG. 2, therein illustrated is a swim suit according to the present invention. More particularly, the garment comprises a multi-Top Construction 6, and a multi-Bottom Construction 8. The multi-Top Construction 6 comprises a Bodice Construction 5 of trendy designs, strap or strap configurations 3 and sometimes a Connection Mechanism 4. The quasi-trendy multi-Bottom Construction 8 comprises a Bottom-wrap 11, Side-wrap 10, to which one of three Melange Segments is added thereby eliminating the bottom front to back side seam. Here, the combination of Wings 9 placed between Side-wrap 10 and Connecting Mechanism 7 creates the Jowings Melange Segment.

FIG. 6 demonstrates how the conceptualization changes with a different Connection Mechanism. Here the Wings 27 has attached a buckle mechanism at 28 and a fabric tie at 26 but both remain in the Jowings Melange Segment category.

Referring to FIG. 7 now, the Zshwings Melange Segment is represented by a Connecting Mechanism of zippers placed at the Front Edges 30 and are attached to the Wings (unnumbered). Niacon 32 may or may not be attached to the Zshwings 30 or the Jowings Melange Segment 29. However, it can also be used without combining by attaching to the Bottom-wrap 37 at the Top Edge 34 and ending with Connecting Mechanism 33.

Referring now to FIG. 2, the swim suit includes a multi-top construction 6 a multi-Bottom construction 8 and a Jowings Melange segment 29 (combination of 9 and 7 at 10) reasonably fastening the front and rear panels together in the front. Such resaleable fastening means known herein as Connecting Mechanisms 7 are well known in the garment art and may include buttons, hooks and eyes, fabric fasteners, zippers, snaps or snap-like fasteners, buckles or buckle-like fasteners, microloop-and-microhook members available under the tradename VELCRO, and the like or other unknown interlocking mechanisms. The Connecting Mechanism 7 at the Bottom Construction means facilitate the wearer of quick removal of garment (for example, for competition where more than one type of activity necessitates the quick change from one sport outfit to another).

The swim suit segments (FIGS. 1–8) may be made from any natural or synthetic material customarily used for swim suits, including silk, nylon, cotton, and the like. Where the material of the crotch portion thereof being formed of cotton or like porous material.

As best seen in (FIGS. 2, 6, 7). The Melange Segments herein known as Jowings 25, 29, Niacon 32 and Zshwings 31 are attached to the Side-wrap 10 and include one or more combinations of parts that connect the Bottom-Wrap 37 at the Side-wrap 10 to the Connecting Mechanism 4, 26, 33 at center front or Connecting Mechanisms at Front Edges 30. The present invention thus produces a swim suit eliminating the bottom front to back side seams while maintaining current, trendy designs.

The multi-Top Constructions as seen in 1, 6, 14, 21 in the present invention consists of any quasi-trendy or trendy designs which are held strategically in place with one or more designed of straps 3, 13, 20, 38 and if needed, Connecting Mechanisms 4, 7, 16, 26, 28, 33.

It is an object of the present invention to overcome the tight and uncomfortable one-piece swim suits as well as the floppy bikini held together with strings and to provide a combination of cooperative elements in the form of a garment which is capable of being put on and removed in a quick manner while maintaining trendy design fashions.

Another object of the present invention is to provide such garment which is constructed in a sturdy manner as to stay in place when entering and leaving the water and at the same time be of a current and trendy design.

A further object of this invention is to provide a garment which is durable and can be worn during athletic events such as the triathlon competition.

Yet another object of the present invention is to provide such a garment, which offers the manufacturer a more economical product. One that can be marketed in a minimum of three sizes rather than the normal eight size production.

Still a further object of the present invention is to provide such a garment which will provide a high quality finished look and utilize new and trendy fabrics and closure mechanisms.

To summarize, the swim suit of the present invention affords both a new and trendy look while maintaining the elimination of the bottom front to back side seam for quick removal, comfort, a slimming effect and economical manufacturing. The present invention relates to a method for making novel swim wear, more particularly, women's swim suits exclusive of side seams by adding "part combinations" known herein as "Melange Segments" making the following attributes available to the wearer: (1) slimming effect; (2) comfort; (3) quick-change and (4) manufacturing savings to the manufacturer. Thus, the present invention can be designed to compliment the current, trendy fashions such as the tong back bottom, the full bottom, ruffled "shorty" look, etc. Therefore the look of conventional swimwear is not compromised when wearing the product of present invention. The side-seam exclusion allows each wearer adjustability for individual comfort. The swim suit is durable and can be worn during heavy activity such as tri-athlete competition. The swim suit can be sold in three sizes and therefore keeping manufacturing costs down.

Now that the preferred embodiments of the present invention have been shown and described in detail, various modifications and improvements thereon will become readily apparent to those skilled in the art. Accordingly, the spirit and scope of the present invention is to be construed broadly and in a manner consistent with the appended claims, and not limited by the foregoing specification.

I claim:

1. A garment for a human wearer, comprising neck and bodice assemblies, a bottom assembly and a closure assembly free of side seams, wherein said neck, bodice, and bottom assemblies lie in a virtually common plane when said garment lies on a planar surface.

said bottom assembly including a front section and a back section, said front section including an under-wrap that fits between the legs and over the buttocks of said wearer to form said back section; and said closure assembly including a first strip and a second strip extending from said back section above the wearer's hips to a connector, said first strip extending laterally from the left side of the back section at an angle with respect to and below the latitudinal axis of the wearer's hips, upwardly over the wearer's left hip to said connector, said second strip extending laterally from the right side of the back section at an angle with respect to and below said latitudinal axis, upwardly over the wearer's right hip to said connector;

said connector affixing said bottom assembly to said closure assembly at the front, back or side of said garment.

2. A garment for a human wearer, comprising neck and bodice assemblies, a bottom assembly and a closure assembly free of side seams, wherein said neck, bodice and bottom assemblies lie in a virtually common plane when said garment lies a planar surface, said bottom assembly including a front section and a back section, said front section including an under-wrap that fits between tie legs and over the buttocks of said wearer to form said back section; and said closure assembly including a first strip and a second strip extending from said back section above the wearer's hips to a connector, said first strip and said second strip extending laterally from said back section around the wearer's mid-section and above tie wearer's hips to said connector, said connector affixing said bottom assembly to said closure assembly at the front, back or side of said garment.

3. The garment of claim 2, further comprising connectors selected from a group of ties, buckles, and zippers or belts, and wherein said connector is a belt, said belt is formed at or near edge of the said back section.

4. The garment of claim 1, further comprising connectors selected from a group of ties, buckles, and zippers or belts, and wherein said connector is a belt, said belt is formed at or near edge of the said back section.

* * * * *